US005929401A

United States Patent [19]

Flegeo et al.

[11] Patent Number: 5,929,401

[45] Date of Patent: Jul. 27, 1999

[54] CURVED KEYBOARD KEYPAD AND CONTACT STRUCTURE

[75] Inventors: Arnaud Flegeo, Challes; Michael Savage, Le Mans, both of France

[73] Assignee: U.S. Philips Corporation, New York, N.Y.

[21] Appl. No.: 09/029,158

[22] PCT Filed: Jun. 9, 1997

[86] PCT No.: PCT/IB97/00661

§ 371 Date: Feb. 19, 1998

§ 102(e) Date: Feb. 19, 1998

[87] PCT Pub. No.: WO97/49107

PCT Pub. Date: Dec. 24, 1997

[30] Foreign Application Priority Data

Jun. 19, 1996 [FR] France ..... 9607635

[51] Int. Cl.[6] ..... H01H 13/70

[52] U.S. Cl. ..... 200/5 A; 200/517; 200/329; 235/145 R

[58] Field of Search ..... 200/5 A, 5 R, 200/512–517, 341–345, 329, 302.2, 314; 235/145 R; 400/472, 485–489

[56] References Cited

U.S. PATENT DOCUMENTS

| | | | |
|---|---|---|---|
| Re. 32,977 | 7/1989 | Gotoh et al. | 200/5 A |
| 3,612,802 | 10/1971 | Beadle et al. | 200/329 |
| 4,046,975 | 9/1977 | Seeger, Jr. | 200/5 A |
| 4,066,851 | 1/1978 | White et al. | 200/5 A |
| 4,322,587 | 3/1982 | Burns et al. | 200/5 R |
| 4,520,248 | 5/1985 | Woelfel | 200/514 |
| 4,560,845 | 12/1985 | Toshiro et al. | 200/5 A |
| 4,605,828 | 8/1986 | Gostomski, Jr. et al. | 200/5 A |
| 4,710,597 | 12/1987 | Loheac | 200/5 A |
| 4,839,474 | 6/1989 | Hayes-Pankhurst et al. | 200/5 A |
| 5,674,076 | 10/1997 | Billings et al. | 434/365 |

FOREIGN PATENT DOCUMENTS

| | | | |
|---|---|---|---|
| WO 94-049974 | 3/1994 | WIPO | G06F 3/023 |

OTHER PUBLICATIONS

Thomas J. Tyranski, Declaration Under 37 C.F.R. § 1.132 (Jan. 7, 1999).

*Primary Examiner*—J. R. Scott
*Attorney, Agent, or Firm*—Dicran Halajian

[57] ABSTRACT

A keypad is disclosed having a rigid plate with openings. A flexible sheet of the keypad has keys which protrude through the openings of the rigid plate. The keypad further includes a rigid insertion plate and a flexible contact sheet with dome-shaped contacts configured to contact the keys. The rigid plate and the rigid insertion plate have a curved shape, where the flexible sheet and the flexible contact sheet are located between the rigid plate and the rigid insertion plate to conform to the curved shape. The curved shape is concave along a longitudinal axis of the keypad and convex along the keypad transversal axis. Further, the top surfaces of the keys protruding from the openings are contoured to conform to the curved shape.

19 Claims, 2 Drawing Sheets

CURVED KEYBOARD KEYPAD AND CONTACT STRUCTURE

BACKGROUND OF THE INVENTION

The invention relates to a curved keypad device, comprising:

on the outside, keys to be handled by the user, and a contact configuration for containing contacts for each of the keys.

Such a device finds highly significant applications in lots of fields: remote control devices, pocket calculators, telephone terminals, etc.

A device of this type is described in Patent Specification PCT No. WO 94/04974. This document describes a keypad for a computer which is to have a great quality of touch. It has a large number of separate keys positioned to correspond to a profile dictated by ergonomics. The fact that a large number of separate keys are to be provided complicates the manufacture and this does not permit to obtain an inexpensive product.

SUMMARY OF THE INVENTION

The invention proposes a device of the type mentioned above which may be provided in an economic manner while having a good quality of touch.

Therefore, such a device is characterized in that said keypad comprises:

a first flexible key-carrying sheet, a second flexible contact sheet for forming said contact configuration, and in that said sheets are curved for conforming in shape to said profile.

These and other aspects of the invention will be apparent from and elucidated with reference to the embodiments described hereinafter.

DESCRIPTION OF THE PREFERRED EMBODIMENTS

Figure 1:
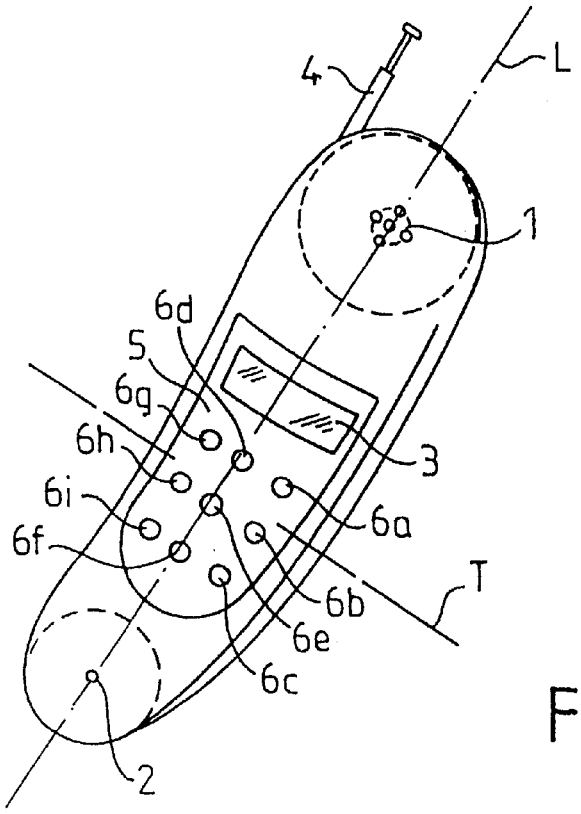
FIG. 1 shows a device according to the invention.

The device shown in FIG. 1 is a telecommunications terminal of the handheld type which is connected to its base by radio. This device has a rounded form to give a handy grip. The device shown in this FIG. 1 has an earpiece 1, a microphone 2, a screen 3, an antenna 4 and a keypad 5 which conforms to the profile defined by the form of the device. This profile may be split up into two profile lines. Along the longitudinal axis L, the keypad 5 has a concave profile line and along the transversal axis T a convex profile line. The keypad 5 comprises keys 6*a*, 6*b*, 6*c*, 6*d*, 6*e*, 6*f*, 6*g*, 6*h*, 6*i* which protrude outward and present themselves harmoniously, similar to said profile.

Figure 2:
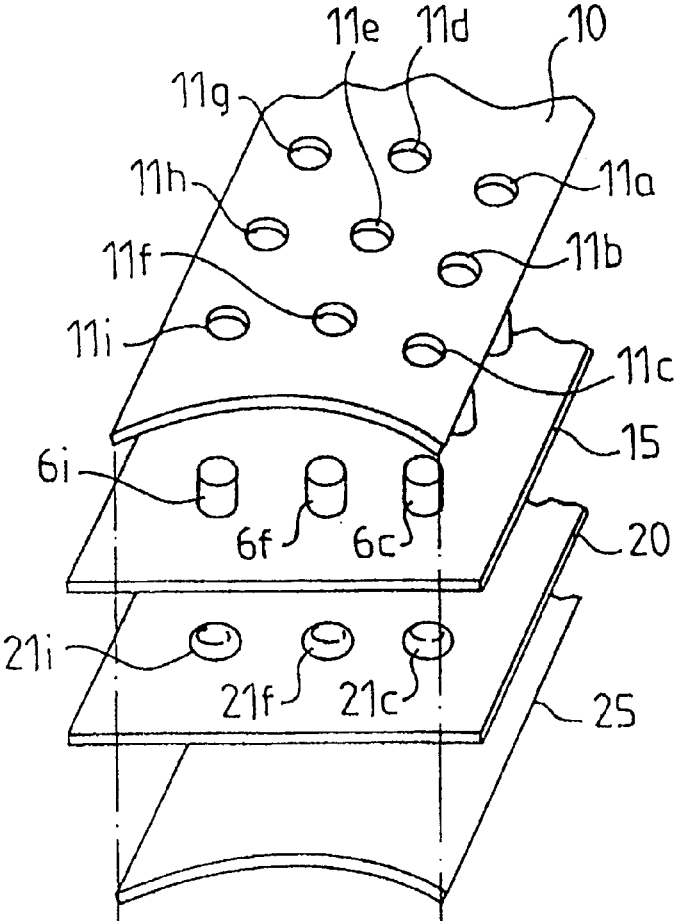
FIG. 2 shows an exploded view of the keypad before its mounting.

FIG. 2 shows a part of the keypad 5 which relates to the second profile line. The keypad 5 is formed by the following component parts:

A rigid exterior plate 10 takes the form of the device and has a certain profile so that the assembly has a harmonious form. This plate 10 has openings 11*a*–11*i* to let all the keys 6*a*–6*i* pass through.

The keys 6*a*–6*i* are formed on a key-carrying sheet 15. Only three keys 6*c*, 6*f* and 6*i* are shown in FIG. 2.

A contact sheet 20 comprising the contacts 21*c*, 21*f* and 21*i* in the form of a dome are only visible in FIG. 2. These contacts are each associated to the respective keys 6*c*, 6*f* and 6*i*.

A rigid supporting or insertion plate 25 for protecting the circuits is accommodated inside the device and has the same profile as the plate 10.

These two sheets are made of flexible plastic material of the elastomer type for the first sheet, of the Mylar type for the second sheet, surrounding metallic lamellas.

Once manufactured, the sheets 15 and 20 always occur in planar form, and therefore they are shown as such in this Figure.

Figure 3:
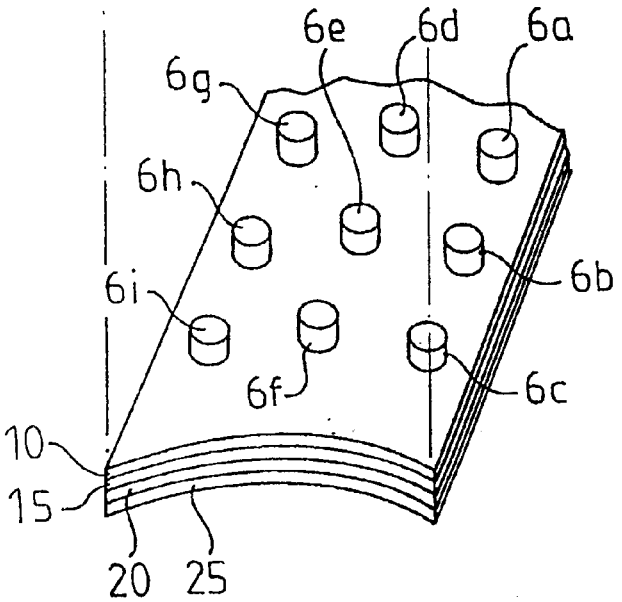
FIG. 3 shows an exploded view of the keypad after its mounting.

FIG. 3 shows the keypad 5 once it has been mounted, that is to say, once the plate 10 which can be clipped into the body of the device, comes close to the intermediate plate 25 taking the shape of the body of the device. This action provides that the sheets 15 and 20 are curved and conform in shape to the desired profile.

Figure 4:
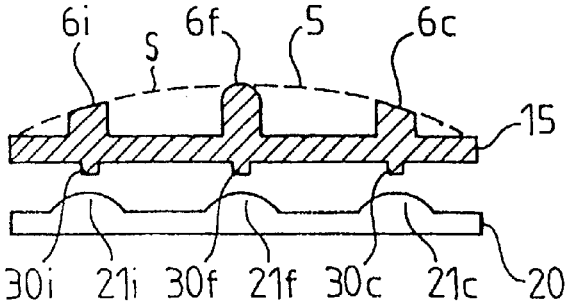
FIG. 4 shows the section of a surface to which the tops of the keys are to be aligned.

For providing that the tops of the keys homogeneously pass through plate 10, these keys are to fit in a section S of a reduced-size surface of the profile during manufacture to compensate for the excessive unevennesses caused by the profile, as is shown in FIG. 4. This Figure also shows the mechanical cooperation of the two sheets 15 and 20. The presence will be noted of studs 30*c*, 30*f* and 30*i* assigned each to keys 6*c*, 6*f* and 6*i* intended to depend on the domes 21*c*, 21*f* and 21*i*.

Figure 5:
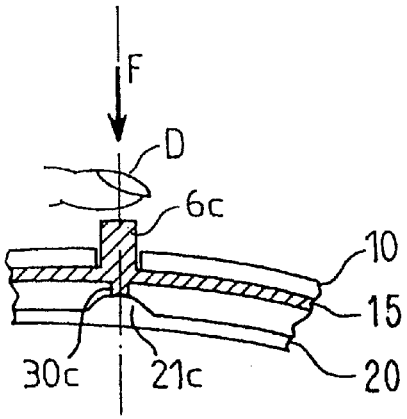
FIG. 5 shows how the pressure of the finger influences the keys.

This curving of the sheets 15 and 20 is particularly advantageous for obtaining free contacts, as is shown in FIG. 5. Indeed, the pressure F of the user's finger is exerted in a normal direction D to the surface of the device, so that the pin 30*c* receiving the force F in the direction D normally transmits the force F to the dome 21*c*, thus in best conditions.

It will be noted that the keypad, being pressed against the casing of the device, takes up minimum space in the device.

It is to be preferred for certain marketed contact sheets 20 that they are curved only along a profile axis.

We claim:

1. A keypad comprising:

a rigid plate having openings;

a flexible sheet having keys which protrude through said openings;

a flexible contact sheet having contacts configured to contact said keys; and a rigid insertion plate, said rigid plate and said rigid insertion plate having a curved shape, wherein said flexible sheet and said flexible contact sheet are located between said rigid plate and said rigid insertion plate to conform to said curved shape.

2. The keypad of claim 1, wherein top surfaces of said keys protruding from said openings are contoured to conform to said curved shape.

3. The keypad of claim 1, wherein said curved shape is concave along a longitudinal axis of said keypad.

4. The keypad of claim 1, wherein said curved shape is convex along a transversal axis of said keypad.

5. The keypad of claim 1, wherein said curved shape is concave along a longitudinal axis of said keypad and convex along a transversal axis of said keypad.

6. The keypad of claim 1, wherein said contacts are dome-shaped.

7. A keypad comprising:

a rigid plate having openings;

a flexible sheet having keys which protrude through said openings;

a flexible contact sheet having contacts configured to contact said keys; and a rigid insertion plate, said flexible sheet and said flexible contact sheet are located between said rigid plate and said rigid insertion plate, wherein said rigid plate and said rigid insertion plate are concave along a longitudinal axis of said keypad and convex along a transversal axis of said keypad.

8. The keypad of claim 7, wherein top surfaces of said keys protruding from said openings are contoured to conform to said curved shape.

9. The keypad of claim 7, wherein said contacts are dome-shaped.

10. A keypad comprising:

a rigid insertion plate;

a rigid plate having openings, said rigid plate and said rigid insertion plate having a curved shape;

a flexible sheet located between said rigid plate and said rigid insertion plate to conform to said curved shape, wherein top surfaces of said keys protruding from said openings conform to said curved shape; and a flexible contact sheet located between said rigid insertion plate and said flexible sheet, said flexible contact sheet having contacts for engaging said keys.

11. The keypad of claim 10, wherein said curved shape is concave along a longitudinal axis of said keypad.

12. The keypad of claim 10, wherein said curved shape is convex along a transversal axis of said keypad.

13. The keypad of claim 10, wherein said curved shape is concave along a longitudinal axis of said keypad and convex along a transversal axis of said keypad.

14. The keypad of claim 10, wherein said contacts are dome-shaped.

15. A device having a keypad, said keypad comprising:

a rigid plate having openings;

a flexible sheet having keys which protrude through said openings;

a flexible contact sheet having contacts configured to contact said keys; and a rigid insertion plate, said rigid plate and said rigid insertion plate having a curved shape, wherein said flexible sheet and said flexible contact sheet are located between said rigid plate and said rigid insertion plate to conform to said curved shape.

16. The device of claim 15, wherein top surfaces of said keys protruding from said openings are contoured to conform to said curved shape.

17. The device of claim 15, wherein said curved shape is concave along a longitudinal axis of said keypad.

18. The device of claim 15, wherein said curved shape is convex along a transversal axis of said keypad.

19. The device of claim 15, wherein said curved shape is concave along a longitudinal axis of said keypad and convex along a transversal axis of said keypad.

* * * * *